US011043350B2

(12) United States Patent
Alibert et al.

(10) Patent No.: US 11,043,350 B2
(45) Date of Patent: Jun. 22, 2021

(54) PHOTOCATHODE WITH NANOWIRES AND METHOD OF MANUFACTURING SUCH A PHOTOCATHODE

(71) Applicants: PHOTONIS FRANCE, Brive (FR); CENTRE NATIONAL DE LA RECHERCHE SCIENTIFIQUE, Paris (FR)

(72) Inventors: Claude Alibert, Saint Gely-du-Fesc (FR); Moustapha Conde, Brive la Gaillarde (FR); Jean-Christophe Harmand, Saint Michel sur Orge (FR); Théo Jegorel, Paris (FR)

(73) Assignees: PHOTONIS FRANCE, Brive (FR); CENTRE NATIONAL DE LA RECHERCHE SCIENTIFIQUE, Paris (FR)

( * ) Notice: Subject to any disclaimer, the term of this patent is extended or adjusted under 35 U.S.C. 154(b) by 222 days.

(21) Appl. No.: 16/305,669

(22) PCT Filed: May 29, 2017

(86) PCT No.: PCT/FR2017/051321
§ 371 (c)(1),
(2) Date: Nov. 29, 2018

(87) PCT Pub. No.: WO2017/207898
PCT Pub. Date: Dec. 7, 2017

(65) Prior Publication Data

US 2020/0328056 A1 Oct. 15, 2020

(30) Foreign Application Priority Data

May 31, 2016 (FR) ..... 1654896

(51) Int. Cl.
*H01J 1/34* (2006.01)
*H01J 9/12* (2006.01)

(52) U.S. Cl.
CPC ..... *H01J 1/34* (2013.01); *H01J 9/12* (2013.01); *H01J 2201/3423* (2013.01)

(58) Field of Classification Search
CPC ..... H01J 1/34; H01J 9/12; H01J 2201/3523
See application file for complete search history.

(56) References Cited

U.S. PATENT DOCUMENTS 6,908,355 B2 6/2005 Habib et al.
10,090,425 B2 * 10/2018 Lewis ..... H01L 31/0687
(Continued)

FOREIGN PATENT DOCUMENTS

CN 103594302 A 2/2014
CN 104752117 A * 7/2015
WO 2003/043045 A2 5/2003

OTHER PUBLICATIONS

CN-104752117-A English machine translation retrieved form Espacenet (Year: 2015).*

(Continued)

*Primary Examiner* — Mariceli Santiago
(74) *Attorney, Agent, or Firm* — Pearne & Gordon LLP

(57) ABSTRACT

The invention discloses a photocathode comprising an amorphous substrate such as a glass substrate (110) presenting an input face that will receive incident photons and a back face opposite the front face. Nanowires (120) made from at least one III-V semiconducting material are deposited on the back face of the substrate and extend from this face in a direction away from the front face. The invention also relates to a method for manufacturing such a photocathode by MBE.

7 Claims, 2 Drawing Sheets

(56) References Cited

U.S. PATENT DOCUMENTS

| | | | | |
|---|---|---|---|---|
| 2003/0222579 | A1* | 12/2003 | Habib | H01J 40/16 313/523 |
| 2010/0180950 | A1* | 7/2010 | Gao | H01L 21/228 136/265 |
| 2013/0207075 | A1 | 8/2013 | Myers et al. | |
| 2015/0146865 | A1* | 5/2015 | Kim | H01J 1/34 378/122 |
| 2016/0273115 | A1* | 9/2016 | Mi | C25B 1/003 |
| 2017/0062637 | A1* | 3/2017 | Shnitser | H01L 31/035227 |
| 2018/0096829 | A1 | 4/2018 | Conde et al. | |

OTHER PUBLICATIONS

International Search Report for International Application No. PCT/FR2017/051321, dated Nov. 20, 2017.

Preliminary French Search Report for French Patent Application No. 1654896 dated Feb. 9, 2017.

Veer Dhaka et al., "High Quality GaAS Nanowires Grown on Glass Substrates", Nano Letters, 2012, pp. 1912-1918, vol. 12, No. 4, ACS Publications.

Pavan Kumar Kasanaboina et al. "Bandgap tuning of GaAs/GaAsSb core-shell nanowires grown by molecular beam epitaxy", Semiconductor Science and Technology, 2015, pp. 1-10, vol. 30, No. 10., IOP Publishing, UK.

Yufeng Zhao et al. "Growth and properties of GaAs nanowires on fused quartz substrate", Journal of Semiconductors, 2014, vol. 35, No. 9, Chinese Institute of Electronics.

Zhao Yu-Feng et al. "Synthesis and Photoluminescence Properties of GaAs Nanowires Grown on Fused Quartz Substrates", Chin. Phys. Lett., 2014, vol. 31, No. 5, Chinese Physical Society and IOP Publishing Ltd.

Kumaresan V et al. "Self-induced growth of vertical GaN nanowires on silica", Nanotechnology, 2016, vol. 27, No. 13, IOP Publishing Ltd.

Xia Sihao et al. "Research on quantum efficiency and photoemission characteristics of negative-electron-affinity GaN nanowire arrays photocathode", Optical and Quantum Electronics, 2016, pp. 1-12, vol. 48, No. 5, Springer.

Jean-Christophe Harmand "Growth of nanowires", Pulse Summer School, Porquerolles, France, Sep. 17, 2015, downloaded on Nov. 29, 2018 from: https://pulse-school.sciencesconf.org/conference/pulse-school/pages/Harmand_Pulse_School_Porquerolles_Harmand.pdf.

* cited by examiner

PHOTOCATHODE WITH NANOWIRES AND METHOD OF MANUFACTURING SUCH A PHOTOCATHODE

TECHNICAL DOMAIN

This invention relates to the field of photocathodes, particularly for electromagnetic radiation detectors such as EBCMOS (Electron Bombarded CMOS) or EBCDD (Electron Bombarded CDD) type image intensifiers or sensors.

STATE OF PRIOR ART

Electromagnetic radiation detectors, for example such as image intensifier tubes and photomultiplication tubes, detect electromagnetic radiation by converting it into a light or electrical output signal. They usually comprise a photocathode to receive electromagnetic radiation and to transmit a flux of photoelectrons in response, an electron multiplication device to receive said flux of photoelectrons and to transmit a flux of secondary electrons in response, and then an output device to receive said flux of secondary electrons and transmit the output signal in response.

The photocathodes convert a flux of incident photons into a flux of photoelectrons. They are usually composed of a substrate transparent to the spectral band of interest and an electro-transmission layer deposited on this substrate.

The photocathodes can be characterised by their QE (Quantum Efficiency) defined as the average percentage of incident photons converted into photoelectrons or by the sensitivity defined as the photocathode current generated by a given light flux.

A distinction can be made between two types of photocathodes.

So-called second generation photocathodes use an electro-transmission layer made from a multi-alkaline compound such as SbNaK or $SbNa_2KCs$, deposed by CVD (Chemical Vapour Deposition) on a glass substrate. The thickness of the photo-transmission layer is normally between 50 and 200 nm. The sensibility of these photocathodes is usually between 700 and 800 μA/lm and its quantum efficiency is relatively low (of the order of 15%).

So-called third generation photocathodes use an electro-transmission layer made of GaAs, epitaxied by MOCVD (Metal Organic Chemical Vapour Deposition) and transferred on a glass substrate. The thickness of the electro-transmission layer is usually of the order of 2 μm. The sensibility of such a photocathode is of the order of 1500 to 2000 μA/lm.

The quantum efficiency of third-generation photocathodes is high, of the order of 30%, but it complex and expensive to fabricate them.

It has been proposed more recently that nanostructured photocathodes can be used, as described in application WO-A-2003/043045. These photocathodes are obtained by etching a channel pattern in an alumina matrix and using an electrodeposition technique to fill these channels with an electro-transmission material such as an alkaline compound or an III-V semiconductor.

The sensitivities of these photocathodes can be high but they are complex to manufacture. In particular, the transfer of the transmissive layer onto a substrate transparent to the spectral band of interest is particularly difficult due to the fragility of the nanostructure. Alternatively, when the nanostructure is directly etched in a substrate forming the input window of the photocathode, an important part of the conversion takes place in the solid part of the semiconducting layer such that the quantum efficiency is reduced by recombinations that occur in it internally.

Consequently, the purpose of this invention is to disclose a photocathode structure that can give high sensitivity levels/quantum efficiency and that is very easy to make. Another purpose of this invention is to disclose a method of manufacturing such a photocathode

PRESENTATION OF THE INVENTION

This invention is defined by a photocathode comprising an amorphous substrate transparent to the spectral working band of the photocathode and with a first face called the front face and a back face opposite the front face, characterised in that it comprises a mat of nanowires made from at least one III-V semiconducting material deposited on said back face and extending from this face in a direction away from the front face.

Advantageously, the substrate is made of glass.

The semiconducting material is chosen from among GaAs, GaN, InGaN, InGaAs, GaP, InGaP, InAs, GaSb, GaAsSb, AlGaAS, AlGaASP and GaBiAs.

Advantageously, the composition of the nanowires has a radial variation in the ratio of the elements in the III-V material so as to obtain a band gap gradient in the direction from the core of the nanowires towards their periphery.

The semiconducting material can be doped by a dopant chosen from among Zn, Be, C or an amphoteric material.

The nanowires are advantageously covered by a layer of activation material chosen from among LiO, CsO or $NF_3$.

The mat of nanowires can be electrically connected to a polarisation electrode deposited on said substrate.

Alternatively, the photocathode can have a transparent contact layer in the working spectral band of the photocathode, connected to the polarisation electrode, the contact layer being located between the mat of nanowires and said substrate. The contact layer may be a layer of ITO, graphene or a polycrystalline layer of strongly P doped III-V semiconducting material.

The photocathode can also comprise an antireflection layer located between the contact layer and said substrate.

The diameter of the nanowires is typically between 50 and 300 nm, preferably between 50 and 150 nm. The density of nanowires can be from $10^5$ to $10^{10}$ $cm^{-2}$ and preferably from $10^8$ to $10^{10}$ $cm^{-2}$.

This invention also relates to a method of manufacturing a photocathode as defined above, according to which the nanowires are made to grow on said substrate by molecular beam epitaxy in a MBE frame.

Before the growth of the nanowires, a gold film can be deposited on said substrate in the same MBE frame at a temperature from 0 to 1200° C. during a duration of 1 to 30 min and it is left to dewet at a temperature of between 400° C. and 700° C. for 1 to 30 min so as to create 5 to 50 nm diameter gold particles. Alternatively, a colloidal solution of 5 to 50 nm diameter gold particles can be dispersed on the surface of the substrate before the growth of the nanowires.

The temperature of the substrate during the nanowires growth phase is advantageously between 400° C. and 700° C.

Atomic fluxes are advantageously calibrated so as to obtain a growth rate of between 0.5 Å/s and 10 Å/s.

According to one variant, the fluxes of materials making up the III-V semiconductor material are varied during the nanowire growth phase, so as to grow a material with a wider band gap at the beginning of the growth phase than at the end of this growth phase.

Advantageously, at the end of the nanowires growth phase, an activation layer made of LiO, CsO or $NF_3$ is deposited within the same MBE frame or without breaking the vacuum.

BRIEF DESCRIPTION OF THE DRAWINGS

Other characteristics and advantages of the invention will become clear after reading a preferred embodiment of the invention with reference to the appended figures among which.

DETAILED PRESENTATION OF PARTICULAR EMBODIMENTS

This invention is based on the surprising observation that under some circumstances, III-V semiconductor nanowires with high crystalline quality can be epitaxied directly on an amorphous structure such as a glass substrate. Research in the past on the growth of nanowires was aimed either at crystalline substrates or amorphous substrates on which a prior surface crystallisation step had been done. In particular, a description of a method of growth of GaAs nanowires on a silicon amorphous substrate with a prior surface crystallisation step is given in the article by Y. Cohin et al. entitled "Growth of vertical GaAs nanowires on an amorphous substrate via a fiber-textures Si platform" published in Nanoletters, May 13, 2013, 13, pp. 2743-2747.

Figure 1A:
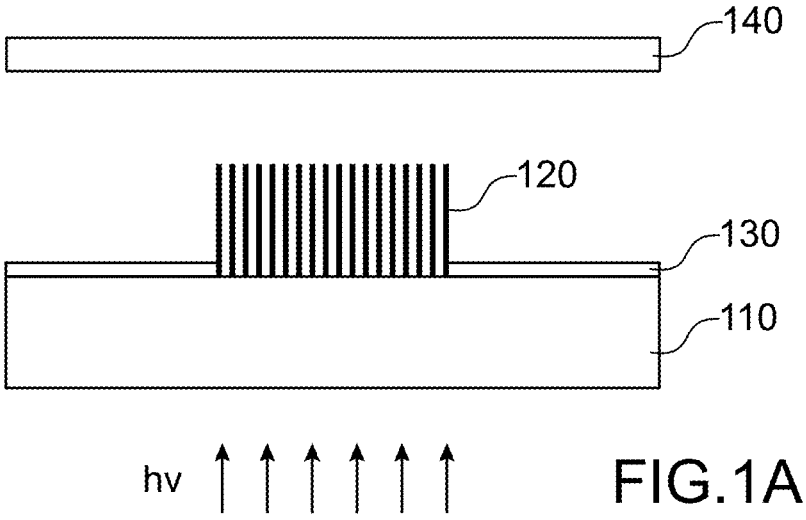
FIG. 1A diagrammatically represents a structure of a nanowire photocathode according to a first embodiment of the invention.

FIG. 1A diagrammatically represents the structure of a nanowire photocathode according to a first embodiment of the invention;

The photocathode comprises an amorphous structure such as a glass substrate 110, forming the input window of the image identifier or the sensor. The material of the amorphous substrate is chosen such that it is transparent in the spectral working band of the photocathode. If applicable, the amorphous substrate can be nanostructured to enable a more uniform distribution of nanowires, at the price of increased complexity. Growth then begins in the nanostructure wells.

The substrate is covered with a mat of nanowires made of a III-V semiconductor material, for example made of GaN, InGaN, InGaAs, GaP, InGaP, InAs, GaSb, GaAsSb, AlGaAS, AlGaASP, GaBiAs and more generally ternary and quaternary alloys of them.

The nanowires are doped with a P type material, for example Zn, Be, C or an amphoteric material such as Si.

The nanowires mat 120 is grown directly on the amorphous substrate by molecular beam epitaxy (MBE), as described below.

Preferably, the diameter of the nanowires varies from 20 to 500 nm, preferably from 50 to 150 nm. The density of the nanowires mat is between $10^5$ and $10^{10}$ $cm^{-2}$, preferably between $10^8$ and $10^9$ $cm^{-2}$.

A metallic layer 130, for example a chromium layer, acts as electrode to apply a polarisation to the nanowires mat. This polarisation is negative with respect to a remote anode (not shown), opposite the photocathode. Photons arriving on the input face of the substrate, transparent to the wave length of interest, generate electron-hole pairs within the nanowires. The holes are eliminated by recombination with electrons brought by the polarisation electrode, 130. Generated electrons can be emitted from anywhere along the length of the nanowires. Advantageously, the nanowires are covered with a layer that reduces the output work, for example made of LiO, CsO or $NF_3$ and therefore facilitates the extraction of electrons in a vacuum.

Electrons extracted from nanowires can then be multiplied by an electron multiplier, 140, such as a microchannel plate or a layer of nanodiamonds (NDs). Secondary electrons thus generated can then form an image on a phosphorescent screen or a matrix of CMOS transistors or even a CCD (EBCCD) matrix, in a manner known in itself. Electrons extracted from the nanowires can possibly impact the back face of an EBCMOS (Electron Bombarded CMOS) sensor directly. The phosphorescent screen, the CCD, CMOS or EBCMOS matrix, form the detector output window.

Figure 1B:
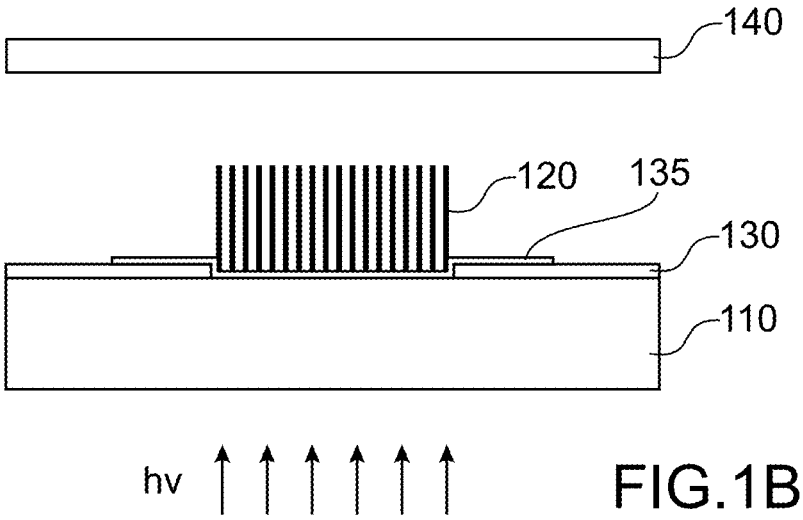
FIG. 1B diagrammatically represents a structure of a nanowire photocathode according to a second embodiment of the invention.

FIG. 1B diagrammatically represents the structure of a nanowire photocathode according to a second embodiment of the invention; Elements identical to elements in FIG. 1A are shown with the same reference numbers and will not be described again.

This second embodiment is different from the first due to the presence of a contact layer 135, transparent in the spectral band of interest and conducting, for example an ITO layer, a graphene layer or even a thin polycrystalline layer of strongly P doped III-V semiconductor material, deposited on the substrate before growth of the nanowires mat. The contact layer, 135, is electrically connected to the polarisation electrode, 130.

Figure 1C:
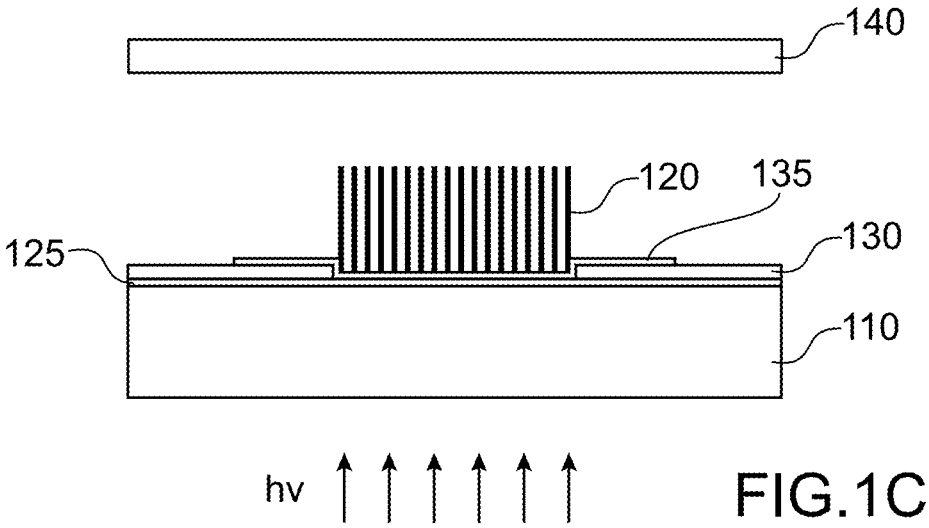
FIG. 1C diagrammatically represents a structure of a nanowire photocathode according to a third embodiment of the invention.

FIG. 1C diagrammatically represents the structure of a nanowire photocathode according to a third embodiment of the invention; Elements identical to elements in FIG. 1B are shown with the same reference numbers and will not be described again.

This second embodiment is different from the first due to the presence of an anti-reflection layer, 125. This anti-reflection layer is deposited on the surface of the substrate before the contact layer 135 is deposited. It prevents light in the working spectral band of the photocathode from being reflected by the interface between the substrate 110, and the contact layer 135.

FIGS. 1A to 1C illustrate embodiments in which the photocathodes operate in transmission in the sense that they are located between the input and output windows of the detector. According to one variant, these photocathodes can operate in reflection. More precisely, the photons flux in this case is incident on the back face of the photocathode (with an angle of incidence determined by an input lens) and photoelectrons generated in the nanowires are emitted by this same back face. Consequently, the input and output windows of the detector in this case are located on the same side of the photocathode.

The method of growth of nanowires on an amorphous substrate such as a glass substrate, possibly after deposition of an anti-reflection layer and a contact layer, are described below.

Originally, nanowires are grown by molecular beam epitaxy (MBE) of the III-V semiconducting material on the amorphous substrate. A gold film is firstly deposited on the substrate to make this possible. Gold is deposited at a temperature of between 800 and 1200° C. (temperature of the MBE cell) on the substrate at ambient temperature or hot, preferably between 400° C. and 700° C., for a duration of 1 to 30 minutes. At the end of the deposition of the gold film, wait for a duration of 30 s to 30 mn, so that the gold can be dewetted on the substrate. 5 to 50 nm diameter particles are then formed on the glass substrate. Alternatively, it is possible to disperse a colloidal solution of gold particles with the above-mentioned size on the substrate surface. In all cases, the gold particles act as precursors for the growth of nanowires of III-V material.

In the second and third embodiments, the gold film is deposited or dispersed on the contact layer. The dewetting and nucleation phenomenon is practically the same as on the glass substrate.

Growth of nanowires then takes place in the same MBE frame, that prevents any contamination by ambient air. It is done within a temperature range from 400 to 700° C. The temperature is measured using a pyrometer adapted to the wave length of the III-V materials from which the nanowires are composed. Atomic fluxes are chosen to correspond to growth rates of between 0.5 Å/s and 10 Å/s. Advantageously, fluxes are calibrated by Reflection High Energy Electron Diffraction (RHEED) observing RHEED observations corresponding to the deposition of successive layers, in a manner known in itself. After a few seconds of growth, the diffraction diagram contains semi-circles indicating the growth of monocrystalline nanowires in a multitude of directions.

This multi-directional growth was confirmed by scanning electron microscopy.

Figure 2:
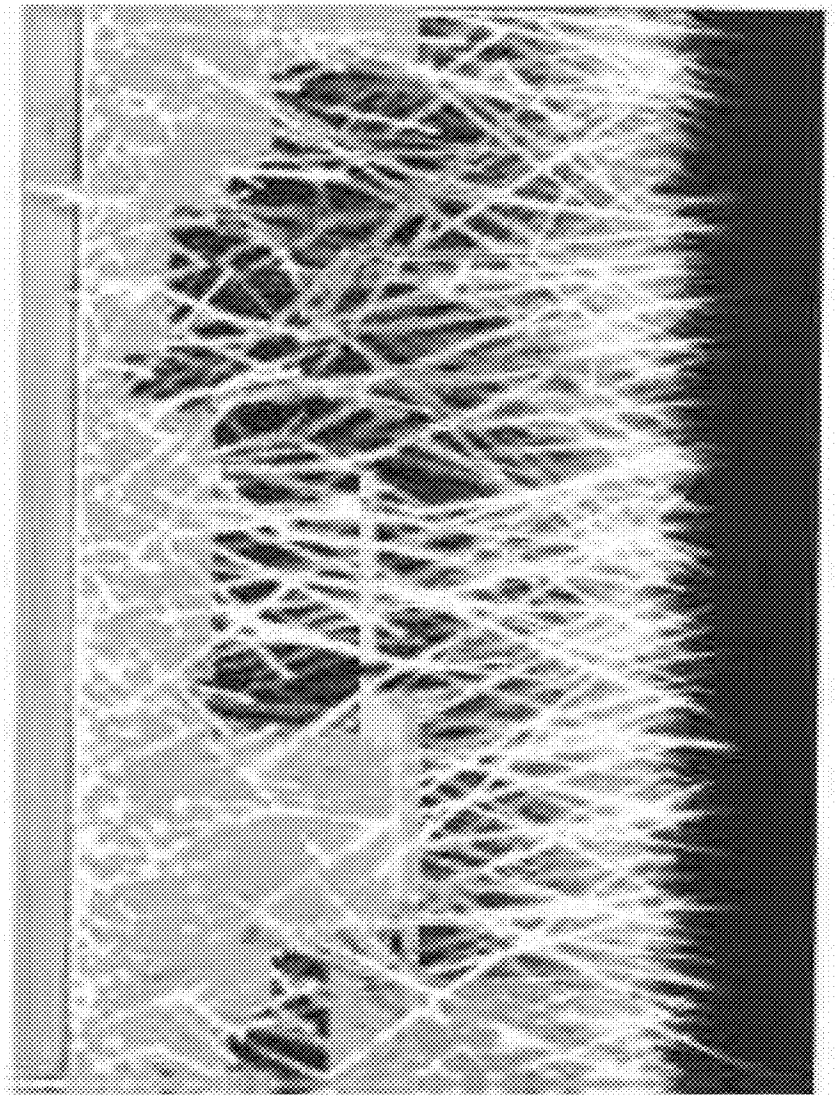
FIG. 2 represents an image obtained by scanning electron microscopy of a photocathode according to one embodiment of the invention.

FIG. 2 represents a plate obtained by scanning electron microscopy (SEM) of a mat of GaAs nanowires that had grown by MBE epitaxy on a glass substrate (Corning™ 7056).

According to one variant, the ratio of III-V material fluxes can be varied during growth such that the nanowires have a wider band gap at their base (and at their periphery) than at the summit (and in-core). More precisely, for an III-V material of the) $X_1^{III} \ldots X_K^{III}Y$ type in which $X_1^{III}, \ldots, X_K^{III}$ are III materials and Y is the V material, the flux of $X_1^{III}, \ldots, X_K^{III}$ materials can be varied relative the flux of V material during epitaxy so as to obtain a band gap gradient in the direction from the core of the nanowires towards their periphery. For example for a III-V material such as the $In_xGa_{1-x}As$ or $Al_xGa_{1-x}As$ ternary compound, the concentration x can be varied during epitaxy.

The variation of the composition, in other words the variation of the fluxes of III materials during epitaxy, can be made by steps in time. Alternatively, it can be gradual so as to obtain a positive band gap gradient in the direction from the core to the periphery of the nanowires. Regardless of the envisaged composition variation law, this variant is capable of absorbing a wider spectral band than when a single homogeneous composition is used.

A LiO, CsO or $NF_3$ activation layer can advantageously be deposited at the end of the growth of nanowires.

Since the diameter of the nanowires is significantly less than the average free path of electrons in the III-V material, there is a high probability that electrons generated in the nanowires will be emitted in the vacuum before being recombined. Emission of photoelectrons can take place along the length of the nanowires. Furthermore, the high electric field due to the tip effect also increases the probability of emission in comparison with a conventional plane photocathode configuration.

The high density of nanowires combined with the low internal recombination rate leads to quantum efficiency and therefore high sensitivity of the photocathode.

What is claimed is:

1. Method of manufacturing a photocathode comprising a glass substrate transparent to the spectral working band of the photocathode and with a first face called the front face and a back face opposite the front face, a mat of nanowires made from at least one III-V semiconducting material deposited on said back face and extending from this face in a direction away from the front face, wherein, the nanowires are made to grow on said substrate by molecular beam epitaxy in a MBE frame, varying the fluxes of materials making up the III-V semiconductor material during the nanowire growth phase, so as to obtain a material exhibiting a radial variation in a ratio of the elements on the III-V material in order to have a band gap gradient in a direction from the core of the nanowires towards their periphery before the growth of the nanowires, a gold film is deposited on said substrate in the same MBE frame at a temperature from 0 to 1200° C. during a duration of 1 to 30 min and it is left to dewet at a temperature of between 400° C. and 700° C. for 1 to 30 min so as to create 5 to 50 nm diameter gold particles.

2. Method of manufacturing a photocathode according to claim 1, wherein a colloidal solution of 5 to 50 nm diameter gold particles are dispersed on the surface of the substrate before the growth of the nanowires.

3. Method of manufacturing a photocathode according to claim 1, wherein the temperature of the substrate during the nanowires growth phase is between 400° C. and 700° C. and in that the atomic fluxes are calibrated so as to obtain a growth rate of between 0.5 Å/s and 10 Å/s.

4. Method of manufacturing a photocathode according to claim 1, wherein, at the end of the nanowires growth phase, an activation layer made of LiO, CsO or $NF_3$ is deposited within the same MBE frame or without breaking the vacuum.

5. Method of manufacturing a photocathode according to claim 2, wherein the temperature of the substrate during the nanowires growth phase is between 400° C. and 700° C. and in that the atomic fluxes are calibrated so as to obtain a growth rate of between 0.5 Å/s and 10 Å/s.

6. Method of manufacturing a photocathode according to claim 2, wherein, at the end of the nanowires growth phase, an activation layer made of LiO, CsO or $NF_3$ is deposited within the same MBE frame or without breaking the vacuum.

7. Method of manufacturing a photocathode according to claim 3, wherein, at the end of the nanowires growth phase, an activation layer made of LiO, CsO or $NF_3$ is deposited within the same MBE frame or without breaking the vacuum.

* * * * *